US011519644B2

(12) United States Patent
Yokoo et al.

(10) Patent No.: US 11,519,644 B2
(45) Date of Patent: Dec. 6, 2022

(54) COOLING DEVICE

(71) Applicant: MITSUBISHI HEAVY INDUSTRIES COMPRESSOR CORPORATION, Tokyo (JP)

(72) Inventors: Kazutoshi Yokoo, Hiroshima (JP); Hiroko Kitamoto, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 126 days.

(21) Appl. No.: 17/178,869

(22) Filed: Feb. 18, 2021

(65) Prior Publication Data

US 2021/0262711 A1 Aug. 26, 2021

(30) Foreign Application Priority Data

Feb. 21, 2020 (JP) ..... JP2020-028002

(51) Int. Cl.
*F25B 39/04* (2006.01)
*F25B 39/00* (2006.01)
*F28F 9/22* (2006.01)

(52) U.S. Cl.
CPC ..... *F25B 39/00* (2013.01); *F28F 9/22* (2013.01); *F25B 39/04* (2013.01); *F25B 2339/046* (2013.01)

(58) Field of Classification Search
CPC .... F25B 39/00; F25B 39/04; F25B 2339/046; F28F 9/22
USPC ..... 62/506
See application file for complete search history.

(56) References Cited

U.S. PATENT DOCUMENTS 4,415,024 A 11/1983 Baker
4,548,260 A 10/1985 Stachura
5,915,469 A * 6/1999 Abramzon ..... F28F 3/025 165/146
6,415,860 B1 * 7/2002 Kelly ..... F28F 7/02 165/DIG. 395
6,460,353 B2 * 10/2002 Udobot ..... F28D 9/0062 62/275

(Continued)

FOREIGN PATENT DOCUMENTS

CA 1121799 A 4/1982
DE 2028729 A1 12/1971

(Continued)

*Primary Examiner* — Claire E Rojohn, III
(74) *Attorney, Agent, or Firm* — Osha Bergman Watanabe & Burton LLP

(57) ABSTRACT

A cooling device includes a cooler disposed inside a shell main body formed in a cylindrical shape, and having a first surface facing an inlet nozzle and an outlet nozzle, and a partition member fixed to the first surface, and partitioning a portion between the cooler and an inner peripheral surface of the shell main body into a first space communicating with the inlet nozzle and a second space communicating with the outlet nozzle. The partition member includes a main partition plate disposed between the inlet nozzle and the outlet nozzle in an axial direction, a first guide portion extending from an end portion of the main partition plate toward a first end surface of the shell main body, and a second guide portion extending from an end portion of the main partition plate toward a second end surface of the shell main body.

10 Claims, 10 Drawing Sheets

(56) References Cited

U.S. PATENT DOCUMENTS

| | | | | |
|---|---|---|---|---|
| 6,942,017 | B2 * | 9/2005 | Gokan | F28F 9/22 123/563 |
| 9,024,460 | B2 * | 5/2015 | Xu | F01D 15/10 290/52 |
| 9,279,612 | B2 | 3/2016 | Bulijina et al. | |
| 10,883,773 | B2 * | 1/2021 | Faber | F28D 7/1684 |
| 2014/0202198 | A1 * | 7/2014 | Bulijina | F28F 13/06 62/440 |
| 2019/0093672 | A1 * | 3/2019 | Saburi | F28D 7/16 |

FOREIGN PATENT DOCUMENTS

| | | | |
|---|---|---|---|
| EP | 2757340 | A2 | 7/2014 |
| JP | H05-187655 | A | 7/1993 |
| JP | H05-322470 | A | 12/1993 |
| JP | H06-042888 | A | 2/1994 |
| JP | H06-109331 | A | 4/1994 |
| JP | H06-341784 | A | 12/1994 |
| JP | H07-063490 | A | 3/1995 |
| JP | H10-206055 | A | 8/1998 |
| JP | 2003-314980 | A | 11/2003 |
| JP | 2006-046696 | A | 2/2006 |
| JP | 2014-137219 | A | 7/2014 |

* cited by examiner

COOLING DEVICE

BACKGROUND OF THE INVENTION

Field of the Invention

The present disclosure relates to a cooling device.

Priority is claimed on Japanese Patent Application No. 2020-028002, filed on Feb. 21, 2020, the content of which is incorporated herein by reference.

Description of Related Art

When a fluid is compressed by a compressor, the temperature of the compressed fluid increases. In a multi-stage compressor, when the compressed fluid is fed to another compressor in a rear stage, a cooling device for cooling the fluid may be used to improve the compression efficiency of the fluid in the compressor in the rear stage in some cases.

For example, Japanese Unexamined Patent Application, First Publication No. 2014-137219 discloses a cooling device having a configuration including a housing formed in a cylindrical shape and a heat exchanger disposed inside the housing as a cooler. In this configuration, the fluid flows into the housing through an inlet port formed in the housing. Inside the housing, the fluid flows into the heat exchanger from an inlet side portion of the heat exchanger, and flows out from an outlet side portion. In the heat exchanger, the fluid flows around a plurality of tubes extending in an axial direction of the housing. A cooling medium (coolant) flows inside the tube. The fluid is cooled by exchanging heat with the cooling medium via the tube.

In this cooling device, it is desirable to improve the heat exchange efficiency of the fluid in the heat exchanger. Therefore, in Japanese Unexamined Patent Application, First Publication No. 2014-137219, a flow homogenizing element having a perforated plate shape is provided in an inlet side portion of the heat exchanger. The flow homogenizing element homogenizes a flow of the fluid flowing into the heat exchanger from the inlet side portion, thereby improving the heat exchange efficiency of the fluid in the heat exchanger as a whole.

SUMMARY OF THE INVENTION

Incidentally, the cooling device disclosed in Japanese Unexamined Patent Application, First Publication No. 2014-137219 includes a separation plate that internally partitions a housing between an inlet port and an outlet port. The separation plate prevents a possibility that the fluid flowing into the housing from the inlet port may flow in an axial direction and may be discharged outward of the housing as it is from the outlet port without passing through the heat exchanger serving as a cooler.

However, since the separation plate is provided, the fluid flowing into the housing from the inlet port is less likely to reach a region on the outlet port side of the separation plate in the axial direction, which is the inlet side portion of the cooler. Therefore, the fluid is likely to concentrate on the region on the inlet side of the separation plate in the axial direction, which is the inlet side portion of the cooling device. Accordingly, there is room for improvement in the heat exchange efficiency in the cooler.

The present disclosure provides a cooling device which can further improve the heat exchange efficiency in the cooler.

According to an aspect of the present disclosure, there is provided a cooling device including a shell having a shell main body formed in a cylindrical shape extending around an axis, an inlet nozzle configured to feed a fluid into the shell main body, and an outlet nozzle disposed away from the inlet nozzle in an axial direction in which the axis extends and configured to feed the fluid inside the shell main body to an outside of the shell main body, a cooler disposed inside the shell main body, configured to cool the fluid flowing from the inlet nozzle toward the outlet nozzle by internally circulating the fluid, and having a first surface extending in the axial direction to face the inlet nozzle and the outlet nozzle, and a partition member fixed to the first surface, and partitioning a space portion between the cooler and an inner peripheral surface of the shell main body into a first space communicating with the inlet nozzle and a second space communicating with the outlet nozzle. The partition member includes a main partition plate disposed between the inlet nozzle and the outlet nozzle in the axial direction, and extending from the first surface to the inner peripheral surface of the shell main body to spread in a direction intersecting with the axis, a first guide portion extending from an end portion on a first side of the main partition plate in the direction intersecting with the axis toward a first end surface of the shell main body close to the inlet nozzle in the axial direction, and a second guide portion extending from an end portion on a second side of the main partition plate in the direction intersecting with the axis toward a second end surface of the shell main body close to the outlet nozzle in the axial direction.

According to the aspect of the cooling device of the present disclosure, the heat exchange efficiency in the cooler can be further improved.

DETAILED DESCRIPTION OF THE INVENTION

Hereinafter, an embodiment for implementing a cooling device according to the present disclosure will be described with reference to the accompanying drawings. However, the present disclosure is not limited only to the embodiment.

(Configuration of Compressor System)

Figure 1:
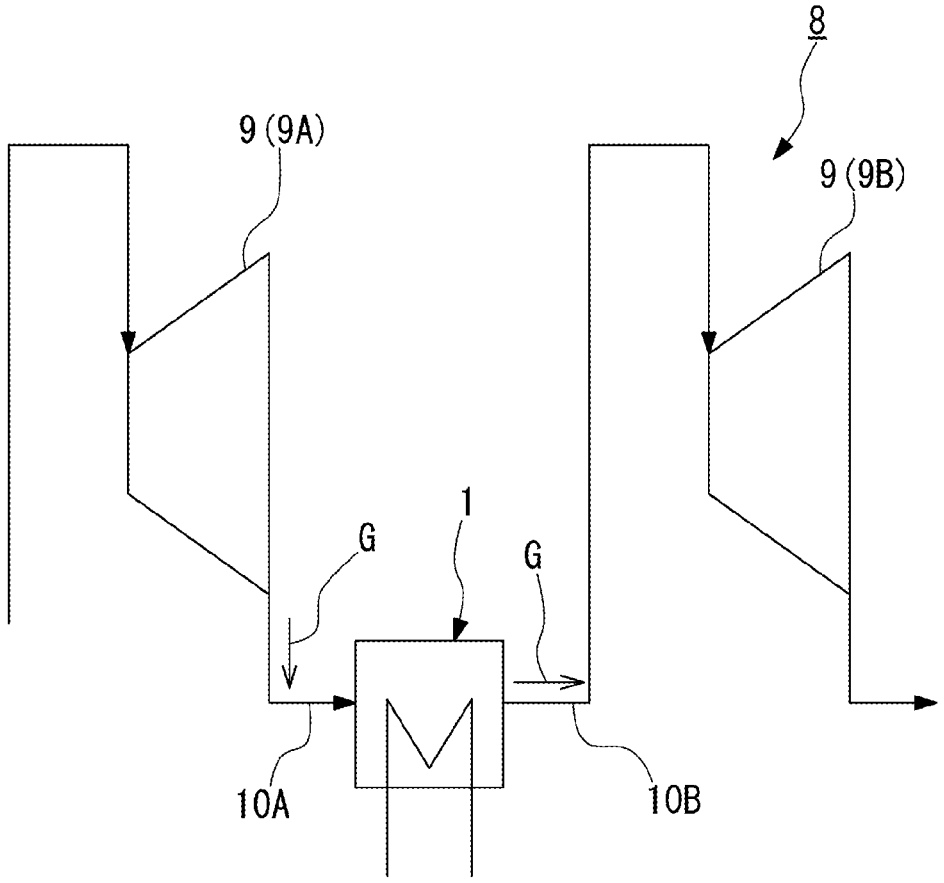
FIG. 1 is a view illustrating a schematic configuration of a compressor system including a cooling device according to the present embodiment.

As illustrated in FIG. 1, a cooling device 1 in the present embodiment is provided in a compressor system 8. The compressor system 8 includes a plurality of compressors 9 provided in series and the cooling device 1. The plurality of compressors 9 are connected to each other in series. In the present embodiment, for example, the compressors 9 are provided at two locations. The number of the compressors 9 provided in the compressor system 8 may be three or more.

A fluid G serving as a compression target in the compressor system 8 is compressed by a compressor 9A in a front stage, and thereafter, is fed into a compressor 9B in a rear stage. The fluid G compressed by the compressor 9A in the front stage is further compressed by the compressor 9B in the rear stage. The cooling device 1 is disposed between the compressor 9A in the front stage and the compressor 9B in the rear stage. The cooling device 1 is connected to an outlet side of the compressor 9A in the front stage via the front stage connection pipe 10A. The cooling device 1 is connected to the inlet side of the compressor 9B in the rear stage via a rear stage connection pipe 10B.

(Configuration of Cooling Device)

Figure 2:
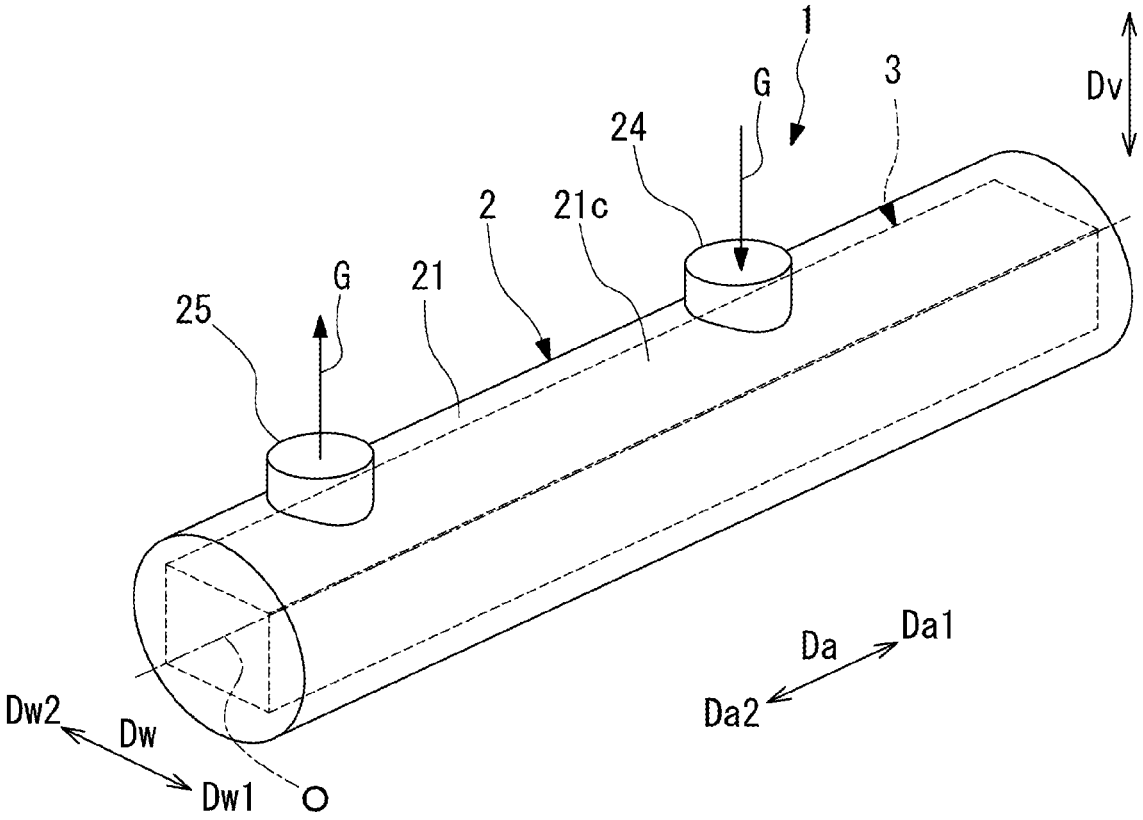
FIG. 2 is a perspective view illustrating an external configuration of the cooling device.
Figure 3:
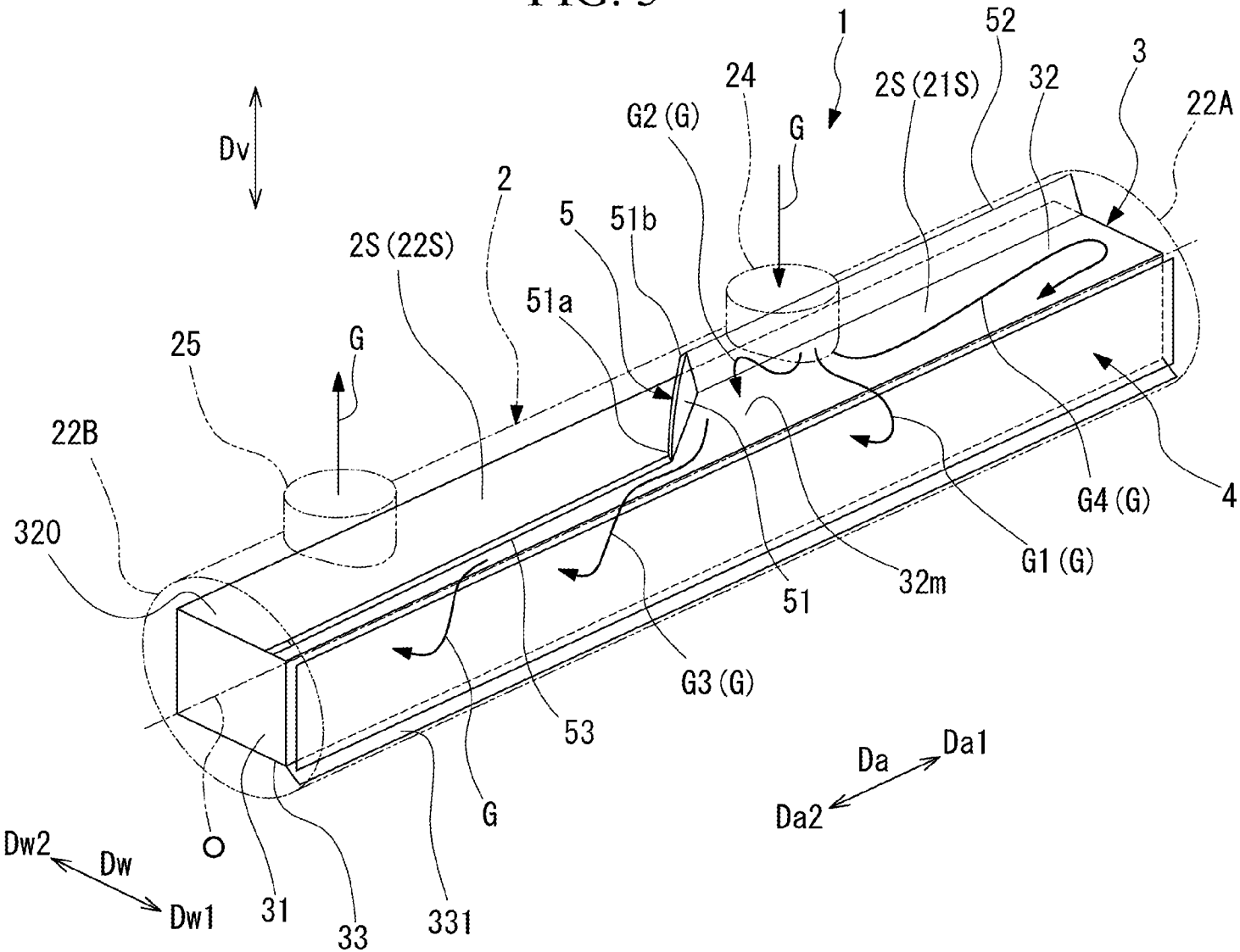
FIG. 3 is a perspective view illustrating a cooler provided in the cooling device.
Figure 4:
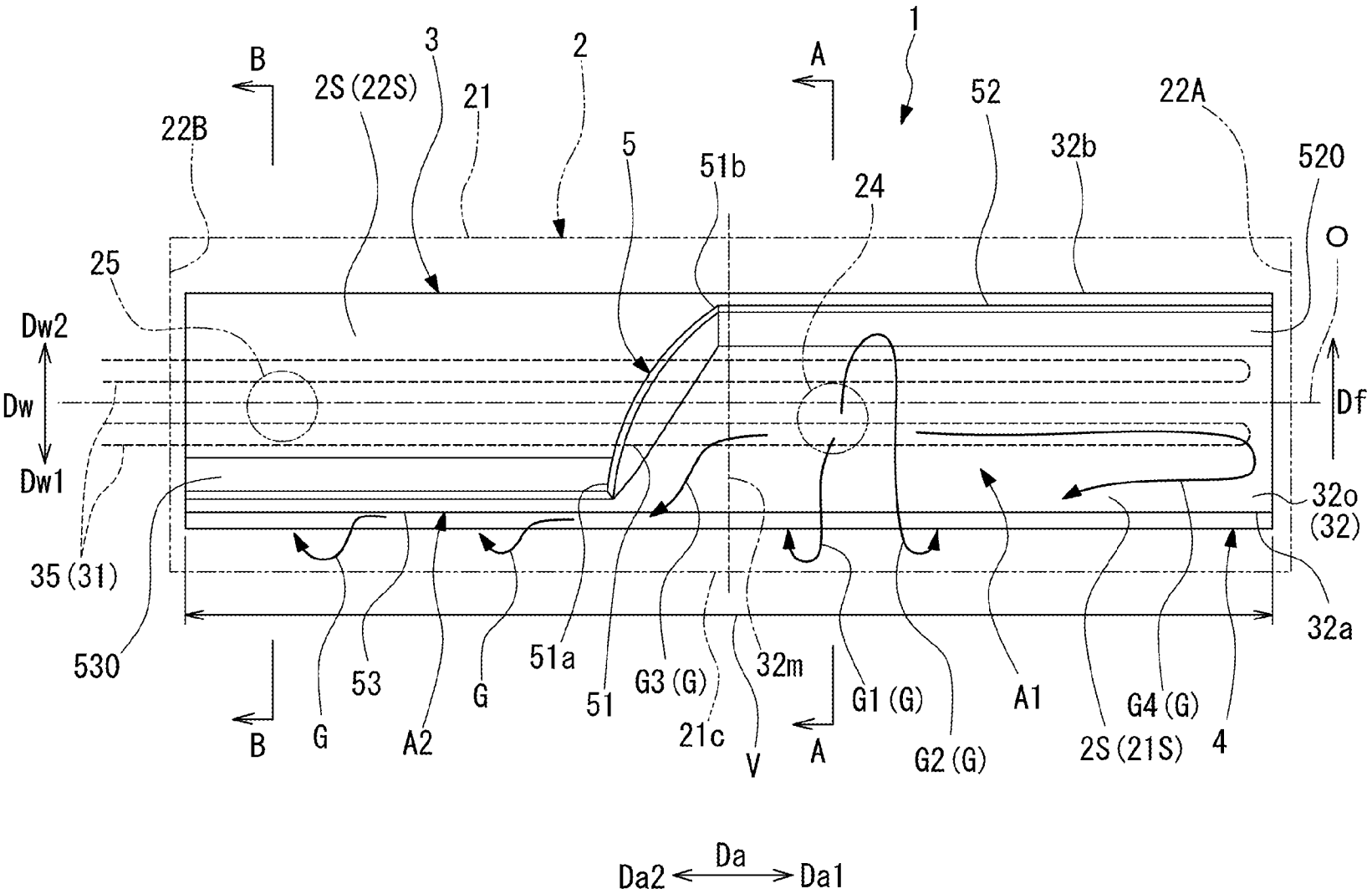
FIG. 4 is a view when the cooler provided inside a shell main body of the cooling device is viewed from above.

As illustrated in FIGS. 2 to 4, the cooling device 1 mainly includes a shell 2, a cooler 3, a partition member 5 (refer to FIGS. 3 and 4), and a perforated plate 4. The cooling device 1 cools the fluid G in a gaseous state, which is compressed by the compressor 9A in the front stage. The cooling device 1 reduces power required for driving the compressor 9B in the rear stage by intermediately cooling the fluid G during a compression process. In the present embodiment, for example, the fluid G cooled by the cooling device 1 is carbon dioxide ($CO_2$) gas containing water. The fluid G cooled by the cooling device 1 is not limited to the carbon dioxide gas, and may be another gas such as air and nitrogen.

(Configuration of Shell)

As illustrated in FIG. 2, the shell 2 has a hollow structure. The shell 2 includes a shell main body 21, an inlet nozzle 24, and an outlet nozzle 25. The shell main body 21 is formed in a bottomed cylindrical shape extending around an axis O. The shell main body 21 is disposed so that the axis O coincides with a horizontal direction. It is preferable that an inner diameter of the shell 2 is as large as possible in order to suppress a drift current of the fluid G inside the shell 2.

Figure 5:
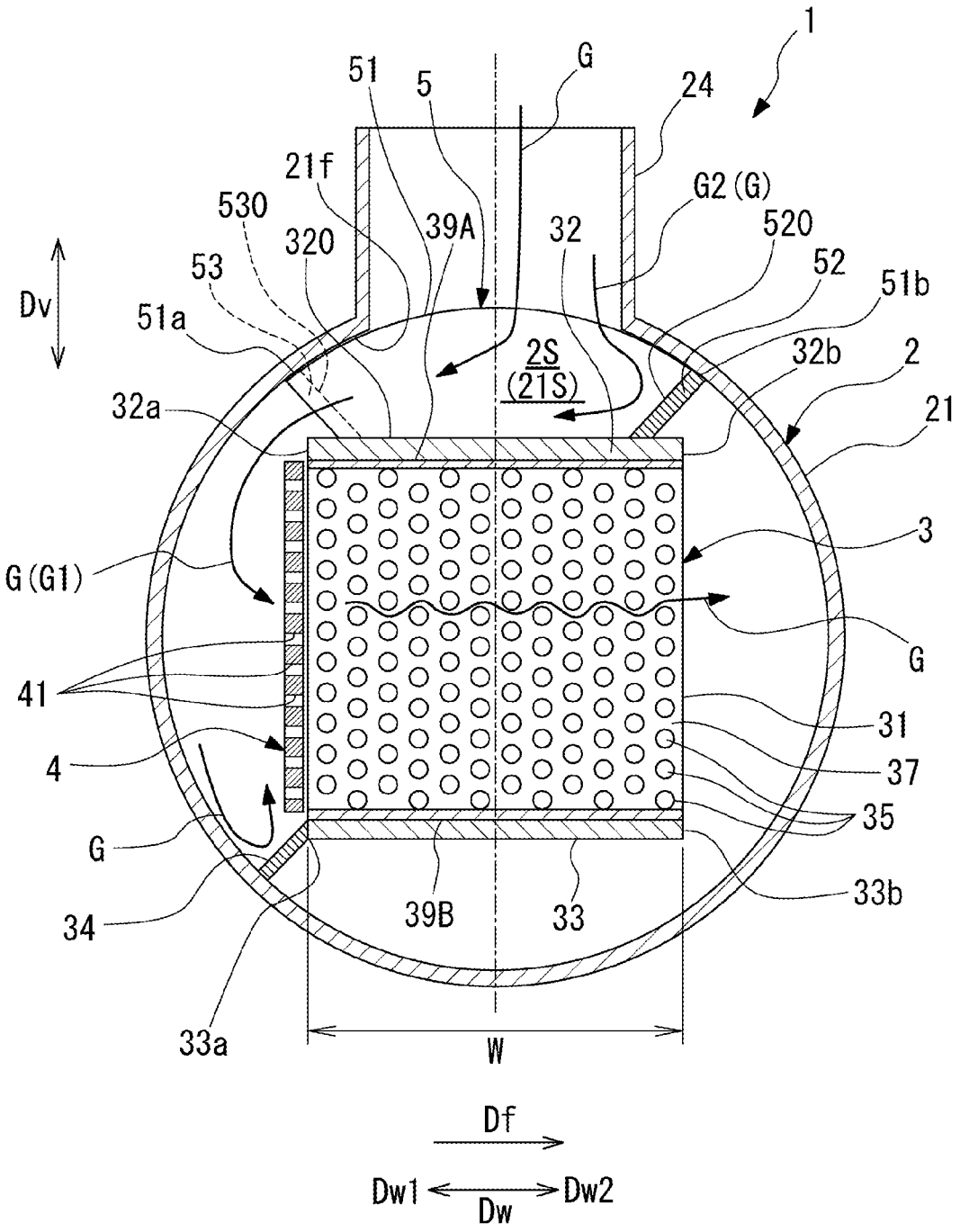
FIG. 5 is a sectional view taken along line A-A in FIG. 4.
Figure 6:
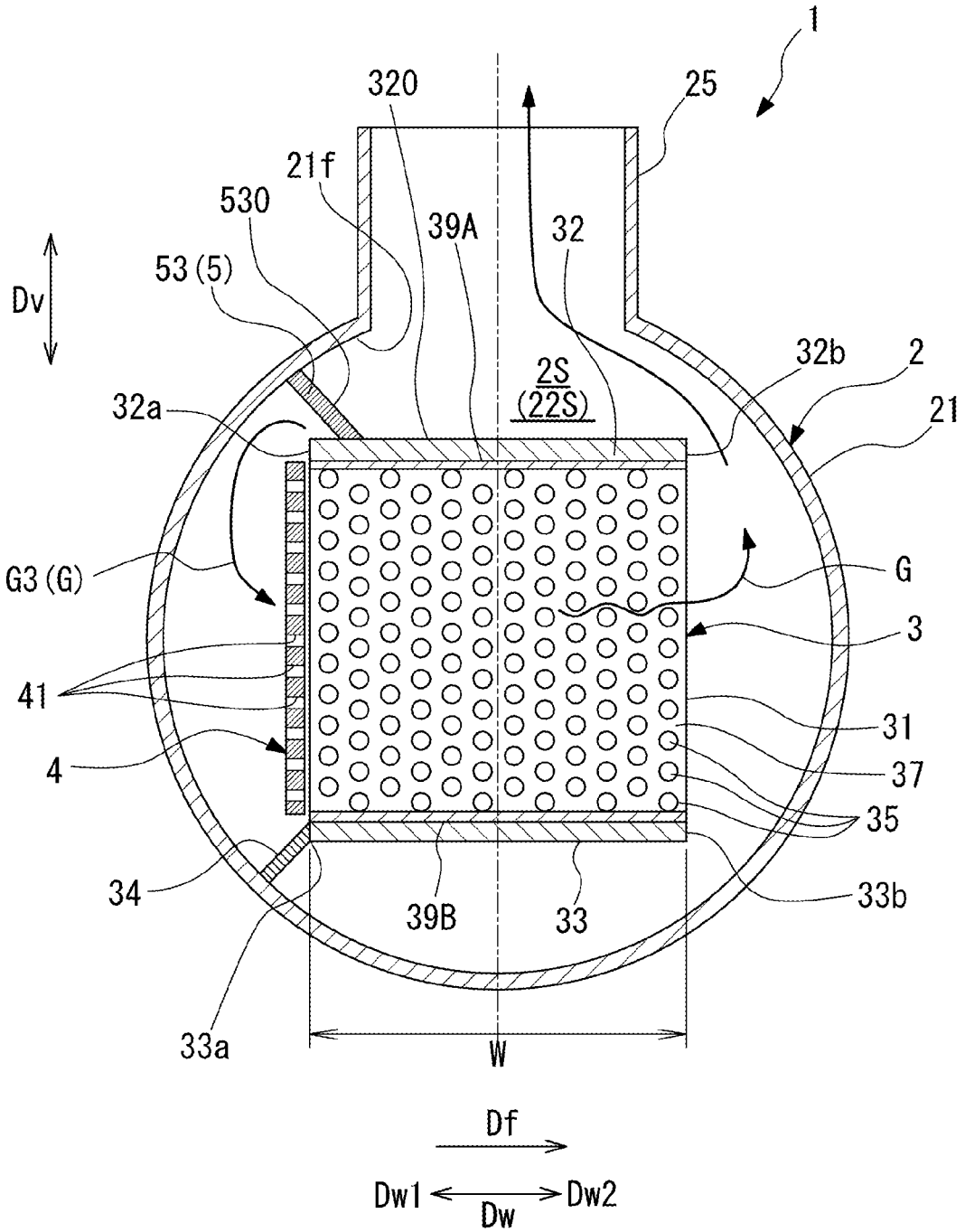
FIG. 6 is a sectional view taken along line B-B in FIG. 4.

The inlet nozzle 24 and the outlet nozzle 25 are integrally connected to the shell main body 21. The inlet nozzle 24 and the outlet nozzle 25 are disposed at a distance in an axial direction Da in which the axis O extends. The inlet nozzle 24 is disposed on a first side Da1 in the axial direction Da with respect to a center 21*c* of the shell main body 21 in the axial direction Da. The outlet nozzle 25 is disposed on a second side Da2 in the axial direction Da with respect to the center 21*c* of the shell main body 21. As illustrated in FIGS. 5 and 6, the inlet nozzle 24 and the outlet nozzle 25 are disposed vertically above an upper portion or to be inclined in a vertical direction Dv with respect to the shell main body 21 disposed in a horizontal state. In addition, the inlet nozzle 24 and the outlet nozzle 25 are formed in a cylindrical shape extending upward in the vertical direction Dv from an upper portion of the shell main body 21. Each lower end of the inlet nozzle 24 and the outlet nozzle 25 is open on an inner peripheral surface 21*f* of the shell main body 21 to communicate with an inside of the shell main body 21.

(Configuration of Cooler)

As illustrated in FIG. 2, the cooler 3 is disposed inside the shell main body 21. The cooler 3 can cool the fluid G by internally circulating the fluid G flowing from the inlet nozzle 24 toward the outlet nozzle 25. As illustrated in FIGS. 3, 5, and 6, the cooler 3 of the present embodiment includes a tube bank 31, a first plate portion 32, and a second plate portion 33. The cooler 3 has a rectangular parallel piped shape extending in the axial direction Da as a whole.

The tube bank 31 includes a plurality of cooling tubes 35 and fin plates 37. Each of the cooling tubes 35 extends in the axial direction Da inside the shell main body 21. As illustrated in FIG. 5, the plurality of cooling tubes 35 are respectively disposed at a distance in the vertical direction Dv and in a width direction Dw (direction intersecting with the axis O in the present embodiment) orthogonal to the axial direction Da. The plurality of cooling tubes 35 are disposed in a so-called staggered array so that the cooling tubes 35 adjacent to each other in the width direction Dw have different installation heights in the vertical direction Dv. That is, the plurality of cooling tubes 35 are disposed so that center lines of three cooling tubes 35 closest to one another form a triangle (equilateral triangle or isosceles triangle) when viewed in the axial direction Da. The cooling tube 35 is folded back in a U-shape on the first side Da1 in the axial direction Da inside the shell main body 21. For example, each of the cooling tubes 35 has a diameter of 30 mm or smaller. For example, as a cooling medium, water is supplied into each of the cooling tubes 35. Inside each of the cooling tubes 35, the water serving as the cooling medium flows from the first side Da1 to the second side Da2 in the axial direction Da, and a flow direction is changed that the water flows back in an end portion on the second side Da2 in the axial direction Da. The water flows from the second side Da2 toward the first side Da1 in the axial direction Da.

Figure 7:
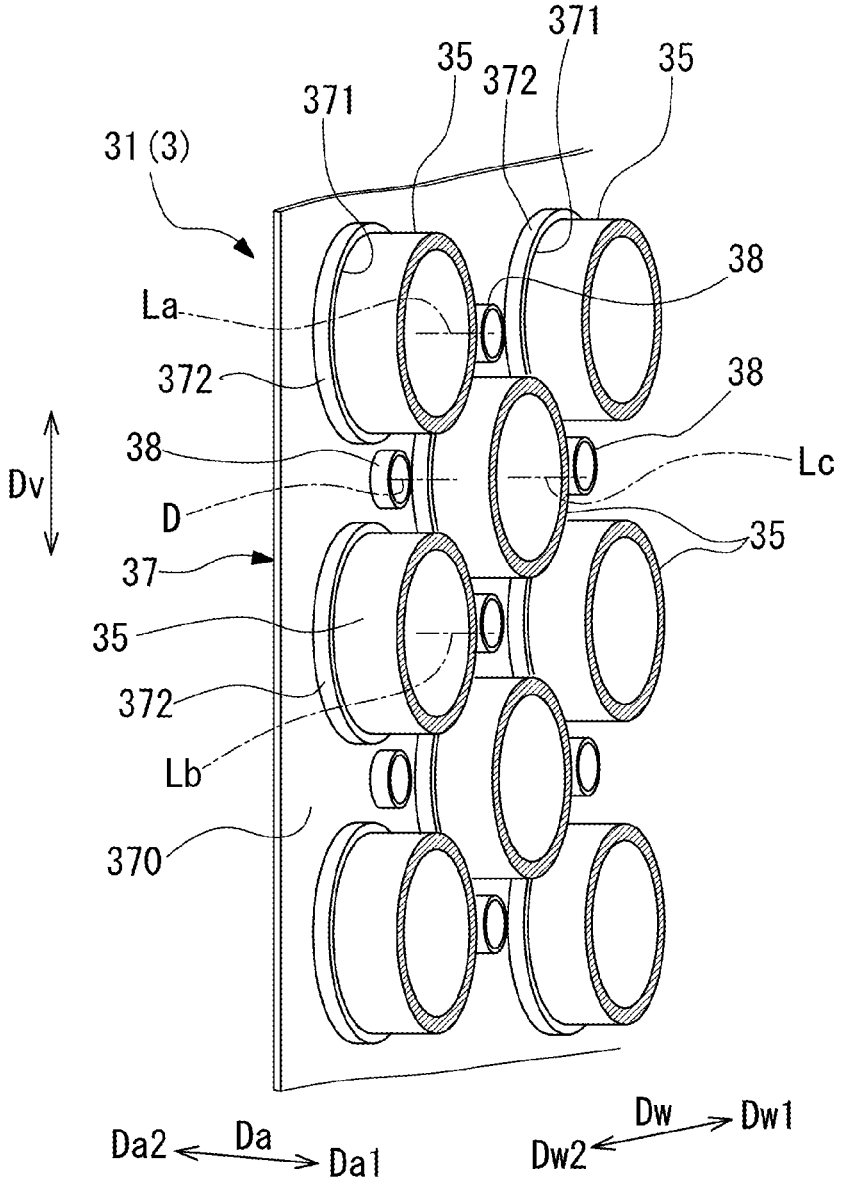
FIG. 7 is a perspective view illustrating a tube and a fin plate which form a tube bank of the cooler.
Figure 8:
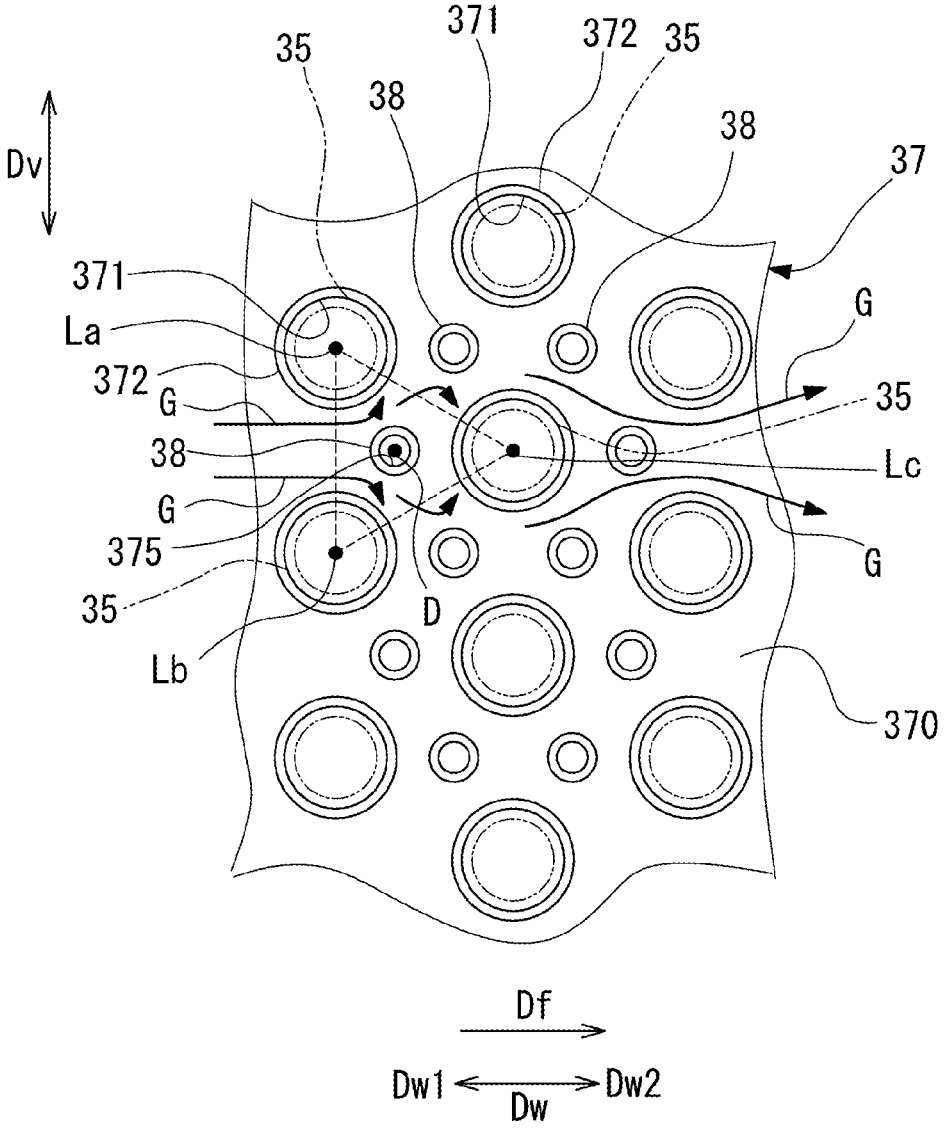
FIG. 8 is a view when the fin plate in FIG. 7 is viewed in an axial direction.
Figure 9:
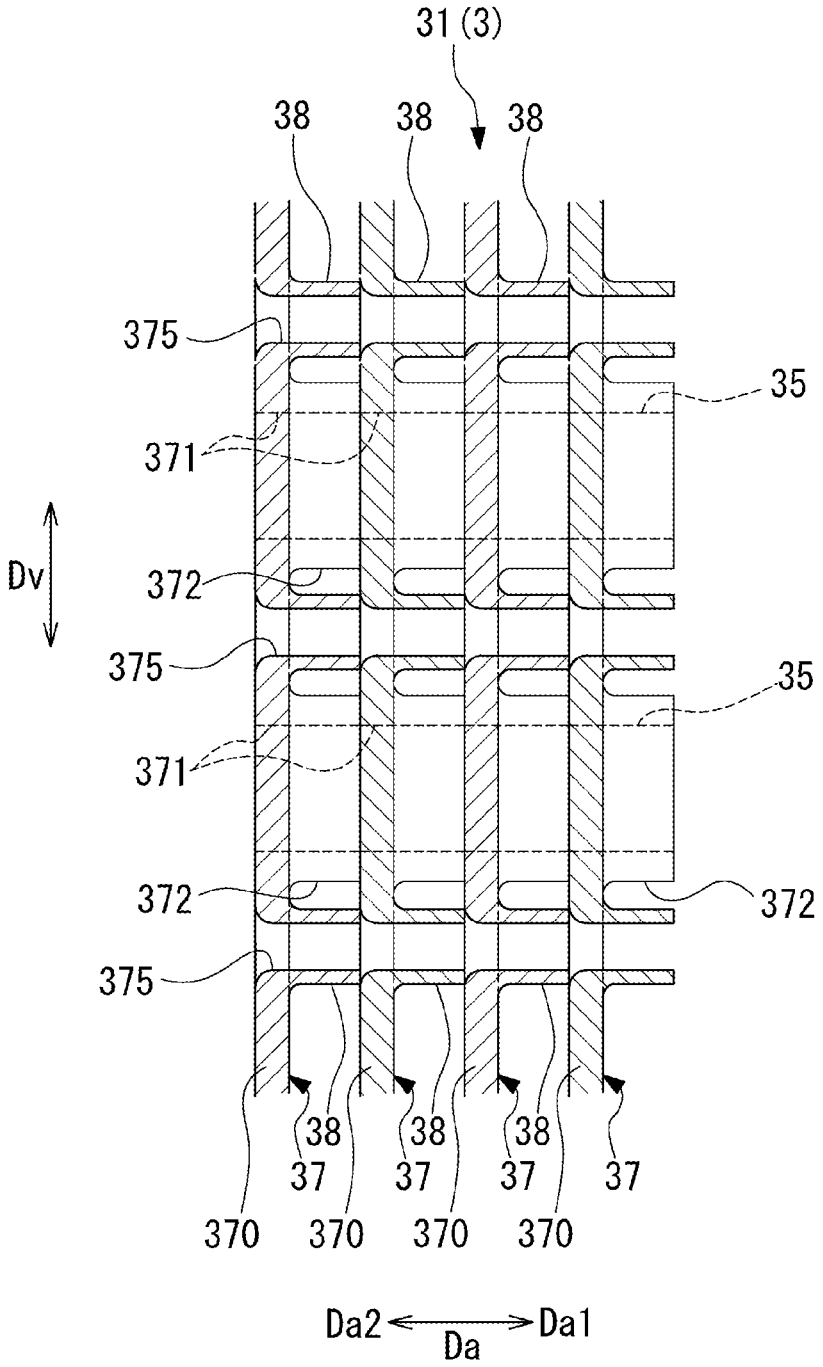
FIG. 9 is a view when the tube bank is viewed in a flow direction.

As illustrated in FIG. 9, a plurality of the fin plates 37 are disposed at a distance in the axial direction Da. In the present embodiment, the fluid G cooled by the cooling device 1 is carbon dioxide gas which is corrosive gas. Therefore, for example, the fin plate 37 is formed of stainless steel having an austenite phase including a material of SUS304 or a material of SUS316 and two-phase stainless steel including the austenite phase and a ferrite phase. In addition, when the fluid G cooled by the cooling device 1 is not the corrosive gas, the fin plate 37 can be formed of an aluminum alloy or copper. As illustrated in FIGS. 7 to 9, the fin plate 37 has a fin plate main body 370, a plurality of tube insertion holes 371, and a plurality of protrusion portions 38. The fin plate main body 370 is formed in a flat plate shape having a surface orthogonal to the axial direction Da.

The tube insertion hole 371 is fixed in a state where the cooling tube 35 is inserted in the axial direction Da. Each of the tube insertion holes 371 penetrates the fin plate main body 370 in the axial direction Da (plate thickness direction). Each of the cooling tube is expanded and joined to or inserted into each of the tube insertion holes 371 so that each of the cooling tubes 35 is in sliding contact therewith. Therefore, the plurality of tube insertion holes 371 are disposed in a staggered array in accordance with a layout of the plurality of cooling tubes 35. That is, the plurality of tube insertion holes 371 are disposed so that center lines La, Lb, and Lc of three tube insertion holes 371 closest to one another form a triangle (equilateral triangle or isosceles triangle) when viewed in the axial direction Da. Each of the tube insertion holes 371 is formed by performing a punching process on the fin plate 37. Each of the tube insertion holes 371 has an edge portion 372 formed through a diameter expansion step or an insertion step during the punching process. The edge portion 372 is formed to protrude in a cylindrical shape in the axial direction Da from a peripheral edge portion of the tube insertion hole 371.

The protrusion portion 38 is formed between the plurality of tube insertion holes 371 when viewed in the axial direction Da. The protrusion portion 38 is a turbulent flow portion that disturbs a flow of the fluid G flowing between the plurality of tube insertion holes 371 in a gap between the pair of fin plate main bodies 370. As illustrated in FIGS. 7 and 8, the protrusion portion 38 is formed at a position D on a center line of the triangle (equilateral triangle or isosceles triangle) drawn by the center lines La, Lb, and Lc of three tube insertion holes 371 closest to one another in the plurality of tube insertion holes 371 disposed in a staggered array. The protrusion portion 38 protrudes to have a through-hole 375 penetrating the fin plate main body 370 from the tube insertion hole 371 toward the first side Da1 (one side) in the axial direction Da, and is formed in a cylindrical shape. The protrusion portion 38 protrudes in a direction the same as that of the edge portion 372. The protrusion portion 38 is formed by performing a punching process on the fin plate 37.

As illustrated in FIG. 9, a protrusion dimension from the fin plate main body 370 in the axial direction Da in each of the protrusion portions 38 is equal to a distance between the fin plate main bodies 370 adjacent to each other in the axial direction Da.

That is, when the fin plates 37 are aligned in the axial direction Da, the protrusion portion 38 protrudes to be in contact with the other fin plate 37 adjacent in the axial direction Da. In addition, in the present embodiment, the protrusion dimension of the protrusion portion 38 is equal to the protrusion dimension from the fin plate main body 370 in the axial direction Da in the edge portion 372.

As illustrated in FIGS. 3, 5, and 6, the first plate portion 32 is disposed above the tube bank 31 in the vertical direction Dv. In this manner, the first plate portion 32 is disposed at a position facing the inlet nozzle 24 and the outlet nozzle 25 with respect to the tube bank 31. The first plate portion 32 has a flat plate shape, and spreads along a plane (horizontal plane) orthogonal to the vertical direction Dv. The first plate portion 32 is formed in a rectangular shape when viewed in the vertical direction Dv orthogonal to the axial direction Da. The first plate portion 32 is disposed to cover the whole tube bank 31 from above in the vertical direction Dv. The first plate portion 32 has a first surface 320 extending in the axial direction Da to face the inlet nozzle 24 and the outlet nozzle 25 in the vertical direction Dv. That is, the first surface 320 is a surface facing upward in the vertical direction Dv in the first plate portion 32.

As illustrated in FIGS. 5 and 6, the second plate portion 33 is disposed on a side opposite to the first plate portion 32 with the tube bank 31 interposed therebetween. That is, the second plate portion 33 is disposed below the tube bank 31 in the vertical direction Dv. The second plate portion 33 has a flat plate shape, and spreads along a plane (horizontal plane) orthogonal to the vertical direction Dv. The second plate portion 33 is formed in a rectangular shape when viewed in the vertical direction Dv. The second plate portion 33 is disposed to cover the whole tube bank 31 from below in the vertical direction Dv.

In the cooler 3, the fluid G comes into contact with the cooling tube 35 of the tube bank 31 by passing between the first plate portion 32 and the second plate portion 33 which are vertically disposed in the vertical direction Dv. Here, the fluid G flows along the width direction Dw orthogonal to the axial direction Da between the first plate portion 32 and the second plate portion 33. That is, the width direction Dw orthogonal to the axial direction Da coincides with a flow direction Df of the fluid G in the cooler 3. In the following description, in the width direction Dw, a side where the fluid G flows into the cooler 3 will be referred to as a first side Dw1, and a side where the fluid G flows out from the cooler 3 will be referred to as a second side Dw2. Therefore, the flow direction Df is a direction from the first side Dw1 toward the second side Dw2 in the width direction Dw.

An end portion 32*a* of the first side Dw1 of the first plate portion 32 in the width direction Dw is disposed at a distance from the shell main body 21. An end portion 32*b* of the second side Dw2 of the first plate portion 32 in the width direction Dw is disposed at a distance from the shell main body 21.

Similarly, an end portion 33*a* of the first side Dw1 of the second plate portion 33 in the width direction Dw is disposed at a distance from the shell main body 21. An end portion 33*b* of the second side Dw2 of the second plate portion 33 in the width direction Dw is disposed at a distance from the shell main body 21.

In addition, it is preferable that the first plate portion 32 and the second plate portion 33 have a distance as small as possible from the tube bank 31 in the vertical direction Dv. In the present embodiment, for example, an upper plate material 39A parallel to the first plate portion 32 is inserted between a lower surface of the first plate portion 32 and an upper end of the fin plate 37. In this manner, the tube bank 31 and the first plate portion 32 are disposed without any gap via the upper plate material 39A. In addition, in the present embodiment, for example, a lower plate material 39B parallel to the second plate portion 33 is inserted between an upper surface of the second plate portion 33 and a lower end of the fin plate 37. In this manner, the tube bank 31 and the second plate portion 33 are disposed without any gap via the lower plate material 39B. In addition, a short pass prevention jig of a structure (rib) having a hydraulic diameter the same as that of the cooling tube 35 may be installed in the upper plate material 39A or the lower plate material 39B. The first plate portion 32 or the second plate portion 33 may be simply disposed to be vertically in close contact with the tube bank 31.

(Configuration of Extension Portion)

In addition, the cooler 3 further includes an extension portion 34. The extension portion 34 extends from the end portion (plate end portion) 33*a* on the first side Dw1 in the width direction Dw in the second plate portion 33 toward the inner peripheral surface 21*f* of the shell main body 21. The extension portion 34 has a flat plate shape. The extension portion 34 extends from the end portion 33*a* of the second plate portion 33 to be inclined toward the first side Dw1 in the width direction Dw, as the extension portion 34 faces downward in the vertical direction Dv. A tip portion of a second guide portion 53 is in contact with the inner peripheral surface 21*f* on a lower side of the shell main body 21.

(Configuration of Partition Member)

As illustrated in FIGS. 3 to 6, the partition member 5 is fixed to the first plate portion 32. The partition member 5 is fixed to the first surface 320. In the shell main body 21, the partition member 5 extends on the first surface 320 to face the second end surface 22B which is the end surface close to the outlet nozzle 25 in the axial direction Da from the first end surface 22A which is the end surface close to the inlet nozzle 24 in the axial direction Da. The partition member 5 partitions a space portion 2S between the cooler 3 and the inner peripheral surface 21*f* of the shell main body 21. Specifically, the partition member 5 partitions the space portion 2S into a first space 21S communicating with the inlet nozzle 24 and a second space 22S communicating with the outlet nozzle 25. The partition member 5 integrally includes a main partition plate 51, a first guide portion 52, and a second guide portion 53.

(Configuration of Main Partition Plate)

As illustrated in FIGS. 3 and 4, the main partition plate 51 extends upward from the first surface 320 in the vertical direction Dv. The main partition plate 51 is formed in a flat plate shape. The main partition plate 51 extends from the first surface 320 to the inner peripheral surface 21*f* of the shell main body 21 to spread in a direction intersecting with the axis O. That is, the main partition plate 51 spreads to cross between the first surface 320 and the inner peripheral surface 21*f* of the shell main body 21.

The main partition plate 51 is disposed between the inlet nozzle 24 and the outlet nozzle 25 in the axial direction Da. The main partition plate 51 is disposed at a position close to the second end surface 22B of the shell main body 21 with respect to a central portion 32*m* of the first plate portion 32 (first surface 320) in the axial direction Da. It is preferable that the main partition plate 51 is disposed at a position offset to the second side Da2 in the axial direction Da by approximately ⅛ to ⅜ of a total length V in the axial direction Da of the first plate portion 32 with respect to the central portion 32*m* of the first plate portion 32 in the axial direction Da. A first end portion 51*a* which is an end portion on the first side Dw1 of the main partition plate 51 in the width direction Dw is disposed at a position away from an end (end portion 32*a* of the first plate portion 32 when viewed in the vertical direction Dv) on the first side Dw1 of the first surface 320 in the width direction Dw. In addition, a second end portion 51*b* which is an end portion on the second side Dw2 of the main partition plate 51 in the width direction Dw is disposed at a position away from an end portion (end portion 32*b* of the first plate portion 32 when viewed in the vertical direction Dv) on the second side Dw2 of the first surface 320 in the width direction Dw.

The main partition plate 51 spreads to be inclined with respect to a plane orthogonal to the axial direction Da. When viewed in the vertical direction Dv, the main partition plate 51 is inclined to face the second side Da2 from the first side Da1 in the axial direction Da, as the main partition plate 51 faces the second end portion 51*b* from the first end portion 51*a*. The tip portion of the main partition plate 51 is in contact with the inner peripheral surface 21*f* on an upper side of the shell main body 21.

(Configuration of First Guide Portion)

The first guide portion 52 extends upward from the first surface 320 in the vertical direction Dv. The first guide portion 52 is formed in a flat plate shape having a plate thickness which is approximately the same as that of the main partition plate 51. The first guide portion 52 is disposed on the first side Da1 in the axial direction Da with respect to the main partition plate 51. The first guide portion 52 extends from the second end portion 51*b* of the main partition plate 51 to the first side Da1 in the axial direction Da. The first guide portion 52 extends to be parallel to the end portion 32*b* of the first plate portion 32 from the second end portion 51*b* toward the first end surface 22A. As illustrated in FIG. 5, the first guide portion 52 is disposed on the second side Dw2 in the width direction Dw from the inlet nozzle 24 when viewed in the axial direction Da. In addition, the first guide portion 52 is disposed at a distance in the width direction Dw from the end portion 32*b* of the first plate portion 32 when viewed in the axial direction Da. It is preferable that the first guide portion 52 is disposed at a position of approximately 20% to 50% of a width dimension W in the width direction Dw of the first plate portion 32 from the end portion 32*b* of the first plate portion 32 to the first side Dw1 in the width direction Dw. The first guide portion 52 has a first guide surface 520 facing the inlet nozzle 24. The first guide surface 520 extends from the first surface 320 to the inner peripheral surface 21*f* of the shell main body 21. The first guide surface 520 is a flat surface inclined to face the inlet nozzle 24. Therefore, the first guide portion 52 having a plate shape extends to be inclined with respect to a virtual surface orthogonal to the first surface 320 to face the second side Dw2 in the width direction Dw, as the first guide portion 52 faces upward from the first plate portion 32 in the vertical direction Dv. The tip portion of the first guide portion 52 is in contact with the inner peripheral surface 21*f* on the upper side of the shell main body 21.

(Configuration of Second Guide Portion)

As illustrated in FIGS. 3 and 4, the second guide portion 53 extends upward from the first surface 320 in the vertical direction Dv. The second guide portion 53 is formed in a flat plate shape having a plate thickness which is approximately the same as that of the main partition plate 51. The second guide portion 53 is disposed on the second side Da2 in the axial direction Da with respect to the main partition plate 51. The second guide portion 53 extends from the first end portion 51*a* of the main partition plate 51 to the second side Da2 in the axial direction Da. As illustrated in FIG. 6, the second guide portion 53 is disposed on the first side Dw1 in the width direction Dw from the outlet nozzle 25 when viewed in the axial direction Da. In addition, the second guide portion 53 is disposed at a distance in the width direction Dw from the end portion 32*a* of the first plate portion 32 when viewed in the axial direction Da. It is preferable that the second guide portion 53 is disposed at a position of approximately 20% to 50% of the width dimension W in the width direction Dw of the first plate portion 32 from the end portion 32*a* of the first plate portion 32 to the second side Dw2 in the width direction Dw. The second guide portion 53 has a second guide surface 530 facing the outlet nozzle 25. The second guide surface 530 extends from the first surface 320 to the inner peripheral surface 21*f* of the shell main body 21. The second guide surface 530 is a flat surface inclined to face the outlet nozzle 25. Therefore, the second guide portion 53 having a plate shape extends to be inclined with respect to the virtual surface orthogonal to the first surface 320 to face the first side Dw1 in the width direction Dw, as the second guide portion 53 faces upward from the first plate portion 32 in the vertical direction Dv. The tip portion of the second guide portion 53 is in contact with the inner peripheral surface 21*f* on the upper side of the shell main body 21.

As illustrated in FIG. 4, when viewed from above in the vertical direction Dv, an area of a first region A1 of the first plate portion 32 exposed on the first side Dw1 in the width direction Dw from the first guide portion 52, which is the first side Da1 in the axial direction Da from the main partition plate 51, is larger than an area of a second region A2 of the first plate portion 32 exposed on the first side Dw1 in the width direction Dw from the second guide portion 53, which is the second side Da2 in the axial direction Da from the main partition plate 51. That is, the area of the first region A1 which is the first surface 320 facing the first space 21S when viewed from above in the vertical direction Dv is larger than the area of the second region A2 which is the first surface 320 facing the second space 22S.

(Configuration of Perforated Plate)

As illustrated in FIGS. 3, 5, and 6, the perforated plate 4 is disposed to face a side surface facing the first side Dw1 in the width direction Dw in the cooler 3. That is, the perforated plate 4 covers the side surface into which the fluid G flows in the cooler 3. The perforated plate 4 is disposed to cover the tube bank 31 from the first side Dw1 in the width direction Dw. The perforated plate 4 is disposed between the first plate portion 32 and the second plate portion 33 in the vertical direction Dv. The perforated plate 4 is formed in a rectangular shape when viewed in the width direction Dw. As illustrated in FIG. 5, the perforated plate 4 has a plurality of holes 41 formed on the entire surface thereof. For example, the plurality of holes 41 are preferably formed so that a pressure loss of the fluid Gin the perforated plate 4 is approximately three times a pressure loss of the fluid G in the tube bank 31. For example, the opening ratio of the plurality of holes 41 in the perforated plate 4 is preferably approximately 10% to 30%. A plurality of the perforated plates 4 may be stacked and installed in the width direction Dw.

(Description of Flow of Fluid inside Shell)

As illustrated in FIGS. 3 to 5, the partition member 5 is provided so that the fluid G flowing into the shell main body 21 from the inlet nozzle 24 flows into the first space 21S. The fluid G flowing into the first space 21S collides with the first plate portion 32, and spreads along the first surface 320. The fluid G1 flowing to the first side Dw1 in the width direction Dw on the first surface 320 passes through a gap between the end portion 32*a* and the inner peripheral surface 21*f* of the shell main body 21 as it is, and flows to the first side Dw1 in the width direction Dw with respect to the tube bank 31 to turn around the end portion 32*a*. In addition, the fluid G2 flowing to the second side Dw2 in the width direction Dw on the first surface 320 hits the first guide portion 52. In this manner, a flow direction thereof is reversed to the first side Dw1 in the width direction Dw.

In addition, the fluid G3 flowing to the second side Da2 in the axial direction Da on the first surface 320 is guided from the second end portion 51*b* toward the first end portion 51*a* along the main partition plate 51, and is guided to the first side Dw1 in the width direction Dw with respect to the second guide portion 53. In addition, the fluid G4 flowing to the first side Da1 in the axial direction Da on the first surface 320 hits the first end surface 22A of the shell main body 21 located on the first side Da1 in the axial direction Da. In this manner, a flow direction thereof is reversed to the second side Da2 in the axial direction Da. In this manner, the fluid G of the space portion 2S is pushed to the second side Da2 in the axial direction Da, and a portion of the fluid G of the space portion 2S is pushed into the first side Dw1 in the width direction Dw with respect to the second guide portion 53.

As illustrated in FIG. 6, the fluid G (G3) flowing to the second side Da2 in the axial direction Da with respect to the main partition plate 51 spreads to the second side Da2 in the axial direction Da along the second guide portion 53 and the first surface 320.

Here, a flow path cross-sectional area of a region surrounded by the second guide portion 53, a virtual extending surface of the first surface 320, and the inner peripheral surface 21*f* of the shell main body 21 in a cross section orthogonal to the axial direction Da is extremely smaller than a flow path cross-sectional area of a region surrounded by the first guide portion 52, the first surface 320, and the inner peripheral surface 21*f* of the shell main body 21. Therefore, a flow velocity of the fluid G flowing from the first side Da1 in the axial direction Da to the second side Da2 in the axial direction Da along the second guide portion 53 with respect to the main partition plate 51 increases. In this manner, the fluid G is more likely to spread to the second side Da2 in the axial direction Da. The fluid G oriented to the second side Da2 in the axial direction Da flows to the first side Dw1 in the width direction Dw with respect to the tube bank 31 to turn around the end portion 32*a* of the first plate portion 32.

(Operational Effect)

In the cooling device 1 having the above-described configuration, the space portion 2S between the first plate portion 32 and the inner peripheral surface 21*f* of the shell main body 21 facing the first plate portion 32 is partitioned by the partition member 5 between the inlet nozzle 24 and the outlet nozzle 25. The fluid G flows from the inlet nozzle 24 into the first space 21S which is the first side Da1 in the axial direction Da with respect to the main partition plate 51. The first guide portion 52 extending to the first side Da1 in the axial direction Da and the second guide portion 53 extending to the second side Da2 with respect to the main partition plate 51 causes the fluid G flowing into the first space 21S to flow to spread to the first side Da1 and the second side Da2 in the axial direction Da inside the first space 21S. In this manner, in the shell main body 21, the fluid G flows from a deep portion on the first side Da1 close to the inlet nozzle 24 in the axial direction Da to a deep portion on the second side Da2 away from the inlet nozzle 24 in the axial direction Da. In this manner, a flow rate distribution of the fluid G flowing into the cooler 3 can be homogenized. As a result, the heat exchange efficiency in the cooler 3 can be further improved.

In addition, the main partition plate 51 is disposed on the second side Da2 in the axial direction Da to be close to the second end surface 22B of the shell main body 21 with respect to the central portion 32*m* of the first plate portion 32 in the axial direction Da. In this manner, the fluid G flowing from the inlet nozzle 24 into the first space 21S flows to spread to the second side Da2 from the center in the axial direction Da until the fluid G reaches the main partition plate 51. As a result, the fluid G can efficiently spread to a wide region on the second side Da2 in the axial direction Da.

In addition, the second guide surface 530 is inclined to face the outlet nozzle 25. In this manner, the fluid G flowing out of the cooler 3 and flowing on the first surface 320 in the second space 22S can be efficiently guided to the outlet nozzle 25.

In addition, the first guide surface 520 is inclined to face the inlet nozzle 24. In this manner, the first guide surface 520 causes the fluid G flowing from the inlet nozzle 24 into the first space 21S to flow along the first surface 320 in the first space 21S. As a result, the fluid G flowing into the shell main body 21 can be efficiently guided to the main partition plate 51, the first guide portion 52, and the second guide portion 53 which are connected to the first surface 320.

In addition, the first end portion 51*a* of the main partition plate 51 is away from the end portion 32*a* of the first plate portion 32. That is, the main partition plate 51 is formed away from the end portion of the first surface 320 in the width direction Dw when viewed in the vertical direction Dv. In this manner, the second guide portion 53 extends at a position away from the end portion 32*a* of the first plate portion 32. Therefore, when viewed in the vertical direction Dv, a portion of the first surface 320 is in a spreading state between the second guide portion 53 and the end portion of the first surface 320. Furthermore, the main partition plate 51 is inclined to face the second side Da2 from the first side Da1 in the axial direction Da, as the main partition plate 51 faces the second end portion 51*b* from the first end portion 51*a* when viewed in the vertical direction Dv. Therefore, the fluid G flowing into the first space 21S is guided by the main partition plate 51 toward the second guide portion 53 located on the second side Da2 in the axial direction Da with respect to the main partition plate 51. The fluid G guided toward the second guide portion 53 further flows toward the second side Da2 in the axial direction Da on the first surface 320 between the second guide portion 53 and the end portion 32*a* of the first plate portion 32. As a result, the fluid G can efficiently spread to a deep portion of the second side Da2 in the axial direction Da.

In addition, the extension portion 34 extending toward the inner peripheral surface 21*f* of the shell main body 21 is formed in the end portion 33*a* on the first side Dw1 in the width direction Dw in the second plate portion 33. The extension portion 34 closes a portion between the second plate portion 33 and the shell main body 21. In this manner, it is possible to prevent a possibility that the fluid G flowing into the lower portion of the second plate portion 33 may flow toward the outlet nozzle 25 to turn around the cooler 3 without passing through the tube bank 31. Therefore, the fluid G inside the shell main body 21 can be efficiently guided to the tube bank 31.

In addition, the first plate portion 32 or the second plate portion 33 is in close contact with the tube bank 31 in the vertical direction Dv. In this way, there is no gap between the first plate portion 32 or the second plate portion 33 and the tube bank 31. Accordingly, it is possible to suppress a possibility that the fluid G may pass upward and downward of the tube bank 31 without passing through the tube bank 31. As a result, the fluid G inside the shell main body 21 can be efficiently guided to the tube bank 31. In this manner, it is possible to suppress a possibility that heat transfer performance of the cooler 3 may be degraded.

In addition, the perforated plate 4 is disposed on the first side Dw1 in the width direction Dw with respect to the tube bank 31. Therefore, the fluid G flowing into the shell main body 21 from the inlet nozzle 24 is fed to the tube bank 31 in a homogenized state by the perforated plate 4. As a result, the heat exchange efficiency in the cooler 3 can be further improved.

In addition, the cooler 3 includes a protrusion portion 38 that protrudes from the fin plate main body 370 in the axial direction Da between the plurality of cooling tubes 35. The fluid G passing through the inside of the tube bank 31 comes into contact with the plurality of cooling tubes 35 when passing through a gap between the fin plate main bodies 370 adjacent to each other in the axial direction Da. In this case, as illustrated in FIG. 8, the fluid G collides with the protrusion portion 38 disposed between the plurality of cooling tubes 35. In this manner, the flow direction of the fluid G is dispersed, and the fluid G is likely to hit the plurality of cooling tubes 35 around the protrusion portion 38. In this manner, the heat exchange efficiency of the fluid G in the tube bank 31 is improved. In addition, in the fin plate 37, a cooling effect between the plurality of cooling tubes 35 is lowered since a distance from the cooling tubes 35 is far. As a result, heat is likely to concentrate, and thermal deformation of the fin plate main body 370 is likely to occur in the portion. The protrusion portion 38 is disposed in the portion where the heat is likely to concentrate in this way. Accordingly, the deformability of the fin plate 37 is improved. As a result, it is possible to suppress the thermal deformation of the fin plate 37. In this manner, it is possible to suppress a decrease in contact resistance of a joint portion between the fin plate 37 and the cooling tube 35.

In particular, the protrusion portion 38 is formed at a center position D of a triangle (equilateral triangle or isosceles triangle) drawn by center lines La, Lb, and Lc of three tube insertion holes 371 closest to one another in the plurality of tube insertion holes 371 disposed in a staggered array. That is, the protrusion portion 38 is formed at a position where the heat is particularly likely to concentrate in the fin plate main body 370. Therefore, since the protrusion portion 38 is disposed in the portion where the heat is particularly likely to concentrate, the deformability of the fin plate 37 is improved. As a result, it is possible to effectively suppress the thermal deformation of the fin plate 37.

Furthermore, the protrusion portion 38 improves the heat exchange efficiency of the fluid G in the tube bank 31. In this manner, even when the fin plate 37 is formed of a two-phase stainless steel material having lower thermal conductivity than an aluminum alloy or copper, cooling performance can be ensured as the cooler 3. As a result, not only the cooling performance but also other performance such as corrosion resistance can be improved.

In addition, the protrusion portion 38 has a cylindrical shape that protrudes from the fin plate main body 370 in the axial direction Da. In this manner, a punching process is performed on the through-hole 375 in the fin plate 37. Accordingly, it is possible to easily form the protrusion portion 38 having the cylindrical shape which protrudes from a peripheral edge portion of the through-hole 375 in the axial direction Da. Therefore, in order to form the protrusion portion 38, it is not necessary to prepare a separate component, and the protrusion portion 38 can be formed at low cost.

Furthermore, the protrusion portion 38 having the cylindrical shape is in contact with the other fin plate main body 370 adjacent in a protrusion direction of the protrusion portion 38 in the axial direction Da. In this manner, the protrusion portion 38 having the cylindrical shape is provided without any gap between the fin plate main bodies 370 adjacent to each other in the axial direction Da. Therefore, the fluid G flowing between the fin plate main bodies 370 can be more efficiently brought into contact with the protrusion portion 38. The fluid G whose flow is disturbed by the protrusion portion 38 flows along the cooling tube 35 between the fin plate main bodies 370. In this manner, the heat exchange efficiency of the fluid G in the tube bank 31 is improved.

OTHER EMBODIMENTS

Hitherto, the embodiment of the present disclosure has been described in detail with reference to the drawings. However, a specific configuration is not limited to the embodiment, and includes a design change within the scope not departing from the concept of the present disclosure.

The turbulent flow portion is not limited to the protrusion portion 38. The turbulent flow portion may have any configuration as long as the flow of the fluid G can be disturbed. Therefore, the turbulent flow portion may be a through-hole penetrating the fin plate main body 370.

Figure 10:
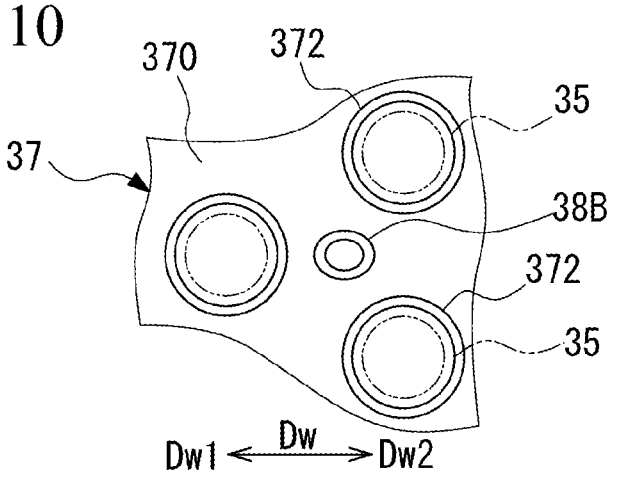
FIG. 10 is a view illustrating a modification example of a protrusion portion provided in the fin plate of the cooling device.
Figure 11:
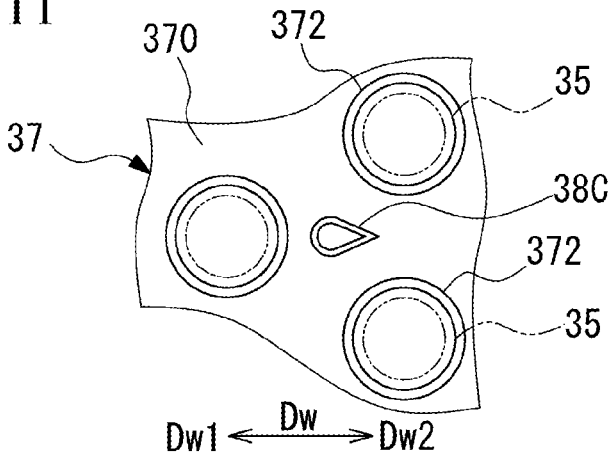
FIG. 11 is a view illustrating a modification example of the protrusion portion provided in the fin plate of the cooling device.
Figure 12:
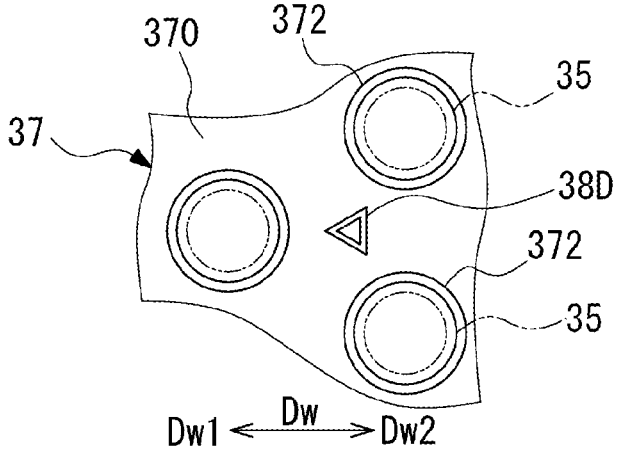
FIG. 12 is a view illustrating a modification example of the protrusion portion provided in the fin plate of the cooling device.

In addition, in the above-described embodiment, the protrusion portion 38 has the cylindrical shape. However, a shape of the protrusion portion 38 is not limited to the cylindrical shape. For example, as illustrated in FIG. 10, a protrusion portion 38B may be formed in an elliptical shape when viewed in the axial direction Da. In addition, as illustrated in FIG. 11, a protrusion portion 38C may be formed in a spindle shape (teardrop shape) when viewed in the axial direction Da. In addition, as illustrated in FIG. 12, a protrusion portion 38D may be formed in a polygonal shape such as a triangular shape when viewed in the axial direction Da. The configurations are similarly applied to a case where the turbulent flow portion is formed as the through-hole instead of the protrusion portion.

In addition, instead of the protrusion portion 38, a slit may be formed around the edge portion 372 of the tube insertion hole 371. In this manner, the rigidity of the fin plate 37 may be lowered to suppress thermal deformation of the fin plate 37.

In addition, as the protrusion portion 38, in addition to the protrusion portion 38 having the cylindrical shape which rises from the peripheral edge portion of the through-hole 375 formed in the fin plate 37, a projection formed to rise from the fin plate 37, a member having a cylindrical shape provided to penetrate the fin plate 37, or a member having a shaft shape may be adopted.

APPENDIX

For example, the cooling device 1 described in the embodiment is understood as follows.

(1) According to a first aspect, the cooling device 1 includes the shell 2 having the shell main body 21 formed in the cylindrical shape extending around the axis O, the inlet nozzle 24 configured to feed the fluid G into the shell main body 21, and the outlet nozzle 25 disposed away from the inlet nozzle 24 in the axial direction Da in which the axis O extends and configured to feed the fluid G inside the shell main body 21 to the outside of the shell main body 21, the cooler 3 disposed inside the shell main body 21, configured to cool the fluid G flowing from the inlet nozzle 24 toward the outlet nozzle 25 by internally circulating the fluid G, and having the first surface 320 extending in the axial direction Da to face the inlet nozzle 24 and the outlet nozzle 25, and the partition member 5 fixed to the first surface 320, and partitioning the space portion 2S between the cooler 3 and the inner peripheral surface 21*f* of the shell main body 21 into the first space 21S communicating with the inlet nozzle 24 and the second space 22S communicating with the outlet nozzle 25. The partition member 5 includes the main partition plate 51 disposed between the inlet nozzle 24 and the outlet nozzle 25 in the axial direction Da, and extending from the first surface 320 to the inner peripheral surface 21*f* of the shell main body 21 to spread in the direction intersecting with the axis O, the first guide portion 52 extending from the end portion on the first side Dw1 of the main partition plate 51 in the direction intersecting with the axis O toward the first end surface 22A of the shell main body 21 close to the inlet nozzle 24 in the axial direction Da, and the second guide portion 53 extending from the end portion on the second side Dw2 of the main partition plate 51 in the direction intersecting with the axis O toward the second end surface 22B of the shell main body 21 close to the outlet nozzle 25 in the axial direction Da.

In the cooling device 1, the fluid G flows from the inlet nozzle 24 into the first space 21S which is the first side Da1 in the axial direction Da with respect to the main partition plate 51. The first guide portion 52 extending to the first side Da1 in the axial direction Da and the second guide portion 53 extending to the second side Da2 with respect to the main partition plate 51 causes the fluid G flowing into the first space 21S to flow to spread to the first side Da1 and the second side Da2 in the axial direction Da inside the first space 21S. In this manner, in the shell main body 21, the fluid G flows from the deep portion on the first side Da1 close to the inlet nozzle 24 in the axial direction Da to the deep portion on the second side Da2 away from the inlet nozzle 24 in the axial direction Da. In this manner, a flow rate distribution of the fluid G flowing into the cooler 3 can be homogenized. As a result, the heat exchange efficiency in the cooler 3 can be further improved.

(2) According to a second aspect of the cooling device 1, in the cooling device 1 of the aspect (1), the main partition plate 51 is disposed at a position close to the second end surface 22B of the shell main body 21 with respect to the central portion 32*m* of the first surface 320 in the axial direction Da.

In this manner, the fluid G flowing from the inlet nozzle 24 into the first space 21S reaches the main partition plate 51, and thereafter, flows to spread to the second side Da2 from the center in the axial direction Da. As a result, the fluid G can efficiently spread to a wide region on the second side Da2 in the axial direction Da.

(3) According to a third aspect of the cooling device 1, in the cooling device 1 of the aspect (1) or (2), the second guide portion 53 has the second guide surface 530 extending from the first surface 320 to the inner peripheral surface 21*f* of the shell main body 21 and inclined to face the outlet nozzle 25.

In this manner, the fluid G flowing out of the cooler 3 and flowing on the first surface 320 in the second space 22S can be efficiently guided to the outlet nozzle 25.

(4) According to a fourth aspect of the cooling device 1, in the cooling device 1 of any one of the aspects (1) to (3), the first guide portion 52 has the first guide surface 520 extending from the first surface 320 to the inner peripheral surface 21*f* of the shell main body 21 and inclined to face the inlet nozzle 24.

In this manner, the first guide surface 520 causes the fluid G flowing from the inlet nozzle 24 into the first space 21S to flow along the first surface 320 in the first space 21S. As a result, the fluid G flowing into the shell main body 21 can be efficiently guided to the main partition plate 51, the first guide portion 52, and the second guide portion 53 which are connected to the first surface 320.

(5) According to a fifth aspect of the cooling device 1, in the cooling device 1 of any one of the aspects (1) to (4), the main partition plate 51 is disposed at a position away from the end portion of the first surface 320 in the width direction Dw orthogonal to the axis O, and the second guide portion 53 extends in the axial direction Da at the position away from the end portion of the first surface 320 in the width direction Dw.

In this manner, the second guide portion 53 extends at a position away from the end portion of the first surface 320. Therefore, when viewed in the vertical direction Dv, a portion of the first surface 320 is in a spreading state between the second guide portion 53 and the end portion of the first surface 320. Therefore, the fluid G guided toward the second guide portion 53 further flows toward the second side Da2 in the axial direction Da on the first surface 320 between the second guide portion 53 and the end portion of the first surface 320. As a result, the fluid G can efficiently spread to a deep portion of the second side Da2 in the axial direction Da.

(6) According to a sixth aspect of the cooling device 1, the cooling device 1 of any one of the aspects (1) to (5) further includes the perforated plate 4 disposed to cover the side surface into which the fluid flows in the cooler 3, and having a plurality of holes.

In this manner, the fluid G flowing into the shell main body 21 from the inlet nozzle 24 is fed to the cooler 3 in a homogenized state by the perforated plate 4. As a result, the heat exchange efficiency in the cooler 3 can be further improved.

(7) According to a seventh aspect of the cooling device 1, in the cooling device 1 of any one of the aspects (1) to (6), the cooler 3 includes the plurality of cooling tubes 35 extending in the axial direction Da, and which the cooling medium configured to flow therein, and the plurality of fin plates 37 having the plate shape orthogonal to the axial direction Da, disposed at a distance in the axial direction Da, and having the plurality of tube insertion holes 371 for fixing the plurality of cooling tubes 35 in a state where the plurality of cooling tubes 35 are inserted in the axial direction Da. Each of the plurality of fin plates 37 has the turbulent flow portion configured to disturb the flow of the fluid G between the plurality of tube insertion holes 371.

In this manner, the fluid G comes into contact with the plurality of cooling tubes 35 when passing through the gap between the fin plates 37 adjacent to each other in the axial direction Da. In this case, the flow of the fluid G is disturbed by the turbulent flow portion disposed between the plurality of cooling tubes 35. Accordingly, the direction of the flow of the fluid G is dispersed, and the fluid G is likely to hit the plurality of cooling tubes 35 around the turbulent flow portion. In this manner, the heat exchange efficiency of the fluid G in the cooling tube 35 is improved.

(8) According to an eighth aspect of the cooling device 1, in the cooling device 1 of the aspect (7), the turbulent flow portion has the protrusion portion 38 having the cylindrical shape to have the through-hole 375 penetrating in the axial direction Da, and protruding in the axial direction Da.

In this manner, the fluid G comes into contact with the plurality of cooling tubes 35 when passing through the gap between the fin plates 37 adjacent to each other in the axial direction Da. In this case, the fluid G collides with the protrusion portion 38 disposed between the plurality of cooling tubes 35. Accordingly, the flow of the fluid G is easily disturbed. In addition, in the fin plate 37, a cooling effect between the plurality of cooling tubes 35 is lowered since a distance from the cooling tubes 35 is far. As a result, the heat is likely to concentrate, and thermal deformation of the fin plate 37 is likely to occur in the portion. The turbulent flow portion is disposed in the portion where the heat is likely to concentrate in this way. Accordingly, the deformability of the fin plate 37 is improved. As a result, it is possible to suppress the thermal deformation of the fin plate 37. In this manner, it is possible to suppress a decrease in contact resistance of a joint portion between the fin plate 37 and the cooling tube 35. In addition, a punching process is performed on the through-hole 375 in the fin plate 37. Accordingly, it is possible to easily form the protrusion portion 38 having the cylindrical shape which protrudes from the peripheral edge portion of the through-hole 375 in the axial direction Da. Therefore, in order to form the protrusion portion 38, it is not necessary to prepare a separate component, and the protrusion portion 38 can be formed at low cost.

(9) According to a ninth aspect of the cooling device 1, in the cooling device 1 of the aspect (8), the protrusion portion 38 protrudes to be in contact with another fin plate 37 adjacent in the axial direction Da among the plurality of fin plates 37.

In this manner, the protrusion portion 38 is provided without any gap between the fin plates 37 adjacent to each other in the axial direction Da. Therefore, the fluid G flowing between the fin plates 37 can be more efficiently brought into contact with the protrusion portion 38. The fluid G whose flow is disturbed by the protrusion portion 38 flows along the cooling tube 35 between the fin plates 37. In this manner, the heat exchange efficiency of the fluid G in the cooler 3 is improved.

(10) According to a tenth aspect of the cooling device 1, in the cooling device 1 of any one of the aspects (7) to (9), the plurality of the tube insertion holes 371 are disposed so that the center lines of three tube insertion holes 371 closest to one another form the triangle when viewed in the axial direction Da. The turbulent flow portion is disposed to be located at the center of the triangle.

In this manner, the turbulent flow portion is formed at a position where the heat is particularly likely to concentrate in the fin plate 37. Therefore, since the turbulent flow portion such as the protrusion portion 38 is disposed in the portion where the heat is particularly likely to concentrate, the deformability of the fin plate 37 is greatly improved. As a result, it is possible to effectively suppress the thermal deformation of the fin plate 37.

EXPLANATION OF REFERENCES

1: cooling device
2: shell
21: shell main body
2S: space portion
21S: first space
22S: second space
21*f:* inner peripheral surface
3: cooler
4: perforated plate
5: partition member
8: compressor system
9, 9A, 9B: compressor
10A: front stage connection pipe
10B: rear stage connection pipe
21*c:* center
22A: first end surface
22B: second end surface
24: inlet nozzle
25: outlet nozzle
31: tube bank
32: first plate portion
320: first surface
32*a:* end portion
32*b:* end portion
32*m:* central portion
33: second plate portion
33*a:* end portion (plate end portion)
33*b:* end portion
34: extension portion
35, 35A, 35B, 35C: cooling tube
37: fin plate
370: fin plate main body
371: tube insertion hole
372: edge portion
375: through-hole
38, 38B, 38C, 38D: protrusion portion (turbulent flow portion)
39A: upper plate material
39B: lower plate material
41: hole
51: main partition plate
51*a:* first end portion
51*b:* second end portion
52: first guide portion
520: first guide surface

53: second guide portion
530: second guide surface
A1: first region
A2: second region
D: center position
Da: axial direction
Da1: first side
Da2: second side
Df: flow direction
Dw: width direction
Dw1: first side
Dw2: second side
Dv: vertical direction
G, G1 , G2, G3, G4: fluid
La, Lb, Lc: center line
O: axis
V: total length
W: width dimension

What is claimed is:

1. A cooling device comprising:

a shell having a shell main body formed in a cylindrical shape extending around an axis, an inlet nozzle configured to feed a fluid into the shell main body, and an outlet nozzle disposed away from the inlet nozzle in an axial direction in which the axis extends and configured to feed the fluid inside the shell main body to an outside of the shell main body;

a cooler disposed inside the shell main body, configured to cool the fluid flowing from the inlet nozzle toward the outlet nozzle by internally circulating the fluid, and having a first surface extending in the axial direction to face the inlet nozzle and the outlet nozzle; and a partition member fixed to the first surface, and partitioning a space portion between the cooler and an inner peripheral surface of the shell main body into a first space communicating with the inlet nozzle and a second space communicating with the outlet nozzle, wherein the partition member includes a main partition plate disposed between the inlet nozzle and the outlet nozzle in the axial direction, and extending from the first surface to the inner peripheral surface of the shell main body to spread in a direction intersecting with the axis, a first guide portion extending from an end portion on a first side of the main partition plate in the direction intersecting with the axis toward a first end surface of the shell main body close to the inlet nozzle in the axial direction, and a second guide portion extending from an end portion on a second side of the main partition plate in the direction intersecting with the axis toward a second end surface of the shell main body close to the outlet nozzle in the axial direction.

2. The cooling device according to claim 1, wherein the main partition plate is disposed at a position close to the second end surface of the shell main body with respect to a central portion of the first surface in the axial direction.

3. The cooling device according to claim 1, wherein the second guide portion has a second guide surface extending from the first surface to the inner peripheral surface of the shell main body and inclined to face the outlet nozzle.

4. The cooling device according to claim 1, wherein the first guide portion has a first guide surface extending from the first surface to the inner peripheral surface of the shell main body and inclined to face the inlet nozzle.

5. The cooling device according to claim 1, wherein the main partition plate is disposed at a position away from an end portion of the first surface in a width direction orthogonal to the axis, and the second guide portion extends in the axial direction at a position away from the end portion of the first surface in the width direction.

6. The cooling device according to claim 1, further comprising:

a perforated plate disposed to cover a side surface into which the fluid flows in the cooler, and having a plurality of holes.

7. The cooling device according to claim 1, wherein the cooler includes a plurality of cooling tubes extending in the axial direction, and which a cooling medium configured to flow therein, and a plurality of fin plates having a plate shape orthogonal to the axial direction, disposed at a distance in the axial direction, and having a plurality of tube insertion holes for fixing the plurality of cooling tubes in a state where the plurality of cooling tubes are inserted in the axial direction, and each of the plurality of fin plates has a turbulent flow portion configured to disturb a flow of the fluid between the plurality of tube insertion holes.

8. The cooling device according to claim 7, wherein the turbulent flow portion has a protrusion portion having a cylindrical shape to have a through-hole penetrating in the axial direction, and protruding in the axial direction.

9. The cooling device according to claim 8, wherein the protrusion portion protrudes to be in contact with another fin plate adjacent in the axial direction among the plurality of fin plates.

10. The cooling device according to claim 7, wherein the plurality of the tube insertion holes are disposed so that a center lines of three tube insertion holes closest to one another form a triangle when viewed in the axial direction, and the turbulent flow portion is disposed to be located at a center of the triangle.

* * * * *